US005405041A

United States Patent [19]

Van Brackle

[11] Patent Number: 5,405,041

[45] Date of Patent: Apr. 11, 1995

[54] SELF DISPENSING TRASH LINER PAIL

[76] Inventor: Michael W. Van Brackle, 120-37 Farmers Blvd., St. Albans, N.Y. 11412

[21] Appl. No.: 144,406

[22] Filed: Nov. 2, 1993

[51] Int. Cl.[6] ..... B65D 25/16

[52] U.S. Cl. ..... 220/407; 220/908; 220/501; 220/404

[58] Field of Search ..... 220/407, 404, 403, 908, 220/23.83, 501, 554

[56] References Cited

U.S. PATENT DOCUMENTS

| | | | |
|---|---|---|---|
| 3,451,453 | 6/1969 | Heck | 150/5 |
| 3,481,112 | 12/1969 | Bourgeios | 220/407 |
| 3,800,503 | 4/1974 | Maki | 220/407 |
| 4,319,694 | 3/1982 | Nehrbass et al. | 220/404 |
| 4,364,490 | 12/1982 | Lang et al. | 220/407 |
| 4,798,363 | 1/1989 | Cortesi | 220/407 |
| 4,850,507 | 7/1989 | Lemongelli et al. | 220/407 |
| 4,955,505 | 9/1990 | Battaglia | 220/407 |

FOREIGN PATENT DOCUMENTS

| | | | |
|---|---|---|---|
| 3701363 | 9/1988 | Germany | 220/407 |

*Primary Examiner*—Stephen J. Castellano
*Attorney, Agent, or Firm*—Richard L. Miller

[57] ABSTRACT

A self dispensing trash liner pail is provided, which consists of a receptacle having a bottom wall and a plurality of upstanding side walls. A dispenser has a top slot formed therethrough. A structure is for retaining the dispenser to the bottom wall of the receptacle. A continuous length of a plurality of separable trash liners are carried as a roll within the dispenser. One trash liner at a time can be pulled out through the to slot in the dispenser, be separated and used in the receptacle for the disposal of trash and similar articles.

1 Claim, 2 Drawing Sheets

SELF DISPENSING TRASH LINER PAIL

BACKGROUND OF THE INVENTION

The instant invention relates generally to refuse receptacles and more specifically it relates to a self dispensing trash liner pail.

Numerous refuse receptacles have been provided in prior art that are adapted to include built in plastic bag dispensers. For example, Heck U.S. Pat. No. 3,451,453; Lang U.S. Pat. No. 4,364,490 et al. and Battaglia U.S. Pat. No. 4,955,505 all are illustrative of such prior art.

While these units may be suitable for the particular purpose to which they address, they would not be as suitable for the purposes of the present invention as heretofore described.

SUMMARY OF THE INVENTION

A primary object of the present invention is to provide a self dispensing trash liner pail that will overcome the shortcomings of the prior art devices.

Another object is to provide a self dispensing trash liner pail that contains a dispenser built into a bottom wall of a trash receptacle, so that once a plastic trash bag within the receptacle is full and removed, the next plastic trash bag is right underneath, to be pulled out of the dispenser for use.

An additional object is to provide a self dispensing trash liner pail, in which the dispenser can be installed and retained to the bottom wall of a conventional trash receptacle.

A further object is to provide a self dispensing trash liner pail that is simple and easy to use.

A still further object is to provide a self dispensing trash liner pail that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

The Figures on the drawings are briefly described as follows.

DETAILED DESCRIPTION OF THE PREFERRED EMBODIMENTS

Figure 1:
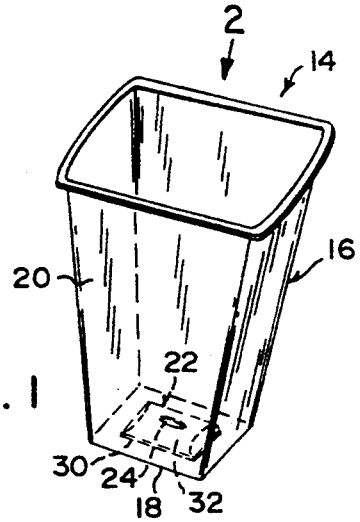
FIG. 1 is a diagrammatic perspective view of the instant invention.

Turning now descriptively to the drawings, in which similar reference characters denote similar elements throughout the several views, FIGS. 1 through 12 illustrate a self dispensing trash liner pail 14 which consists of a receptacle 16 having a bottom wall 18 and a plurality of upstanding side walls 20. A dispenser 22 has a top slot 24 formed therethrough. A structure 26 is for retaining the dispenser 22 to the bottom wall 18 of the receptacle 16. A continuous length of a plurality of separable trash liners **28*a* are carried as a roll 28 within the dispenser 22. One trash liner 28*a* at a time can be pulled out through the top slot 24 in the dispenser 22, be separated and used in the receptacle 16** for the disposal of trash and similar articles.

The dispenser 22 includes a rectangular base 30, with a hemi-cylindrical cover 32, having the top slot 24 to fit over the rectangular base 30, with the roll of trash liners **28*a* therein. A latch mechanism 34 is located between the rectangular base 30 and the dome shaped cover 32, so that the hemi-cylindrical cover 32 and the rectangular base 30** can be removably attached to each other.

Figure 3:
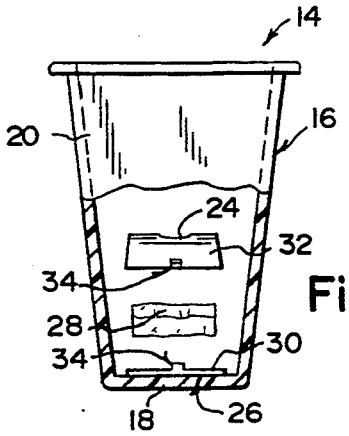
FIG. 3 is a side elevational view of a first embodiment taken in the direction of arrow 3 in FIG. 2, partly cut away and in section to show in an exploded manner the internal components thereto.
Figure 2:
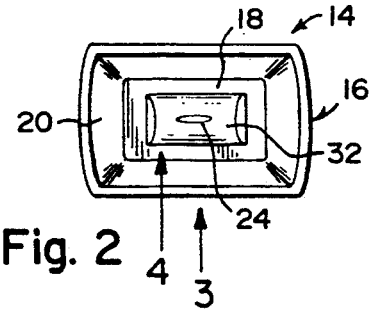
FIG. 2 is a top plan view taken in the direction of arrow in FIG. 1.
Figure 4:
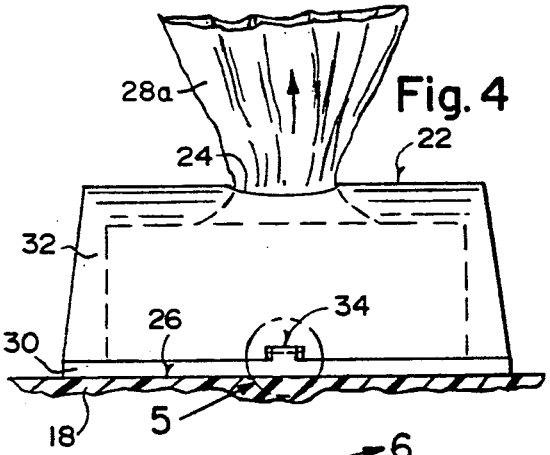
FIG. 4 is an enlarged diagrammatic side elevational view of the first embodiment of the bag dispensing component per se taken in the direction of arrow 4 in FIG. 2.

The retaining structure 26, as best seen in FIGS. 3 and 4, consists of the rectangular base 30 formed to and is integral with the bottom wall 18 of the receptacle 16. The hemi-cylindrical cover 32 is removable away from the rectangular base 30, for loading of the roll 28 of trash liners **28*a***.

Figure 7:
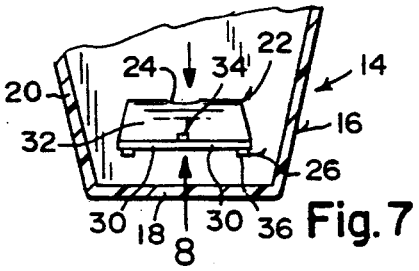
FIG. 7 is a side elevational view similar to FIG. 3, partially in section with parts broken away illustrating a second embodiment of the instant invention.
Figure 5:
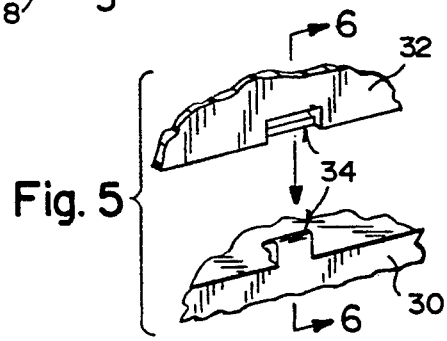
FIG. 5 is an enlarged partially exploded view with parts broken away of the area indicated by arrow 5 in FIG. 4.
Figure 8:
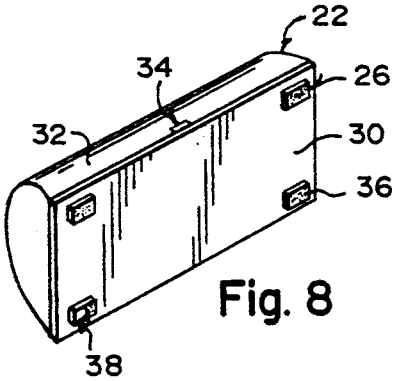
FIG. 8 is a diagrammatic perspective view taken generally in the direction of arrow 8 in FIG. 7.
Figure 6:
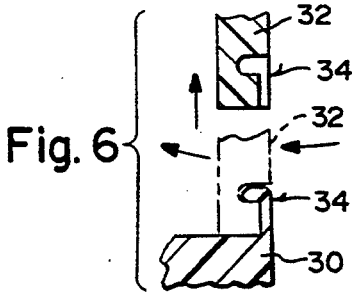
FIG. 6 is a still further enlarged cross sectional view with parts broken away taken along line 6—6 of FIG. 5.
Figure 9:
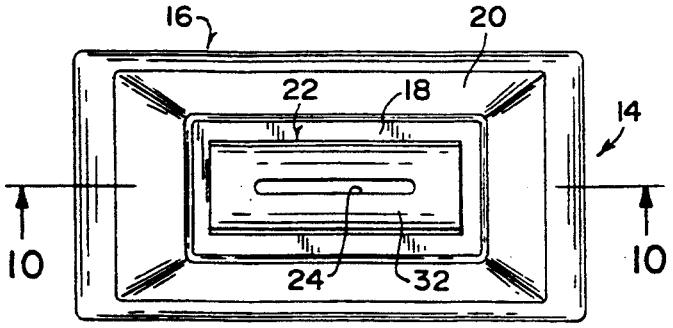
FIG. 9 is a top plan view of a third embodiment of the instant invention.

The retaining structure 26, as shown in FIGS. 7 and 8, includes a plurality of adhesive pads 36 affixed to the underside of the rectangular base 30. A plurality of peel away protective strips 38 are on the adhesive pads 36. When the protective strips 38 are removed from the adhesive pads 36, the adhesive pads 36 can be pressed onto the bottom wall 18 of the receptacle 66.

Figure 11:
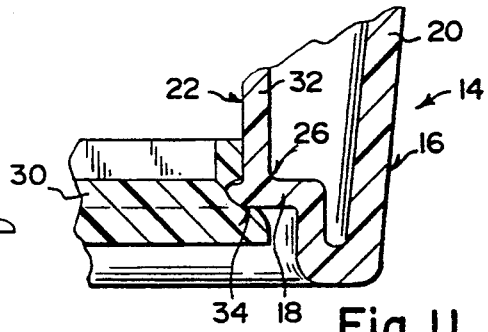
FIG. 11 is a greatly enlarged partial side cross sectional view of just the area indicated by arrow 11 in FIG. 10.
Figure 10:
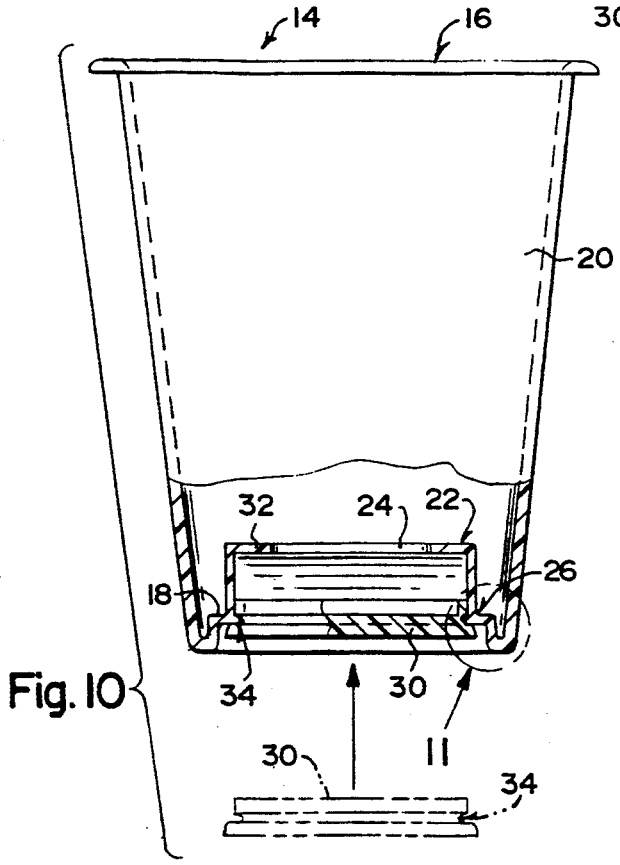
FIG. 10 is a side elevational view partly in cross section taken on line 10—10 of FIG. 9.
Figure 12:
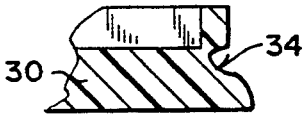
FIG. 12 is a cross sectional view with parts broken away of just the bottom lid per se.

The retaining structure 26, as shown in FIGS. 10 and 11 consists of the hemi-cylindrical cover 32 formed to and is integral with the bottom wall 18, which is recessed in the receptacle 16. The rectangular base 30 is now removable away from the hemi-cylindrical cover 32 at the underside of the receptacle 16, for loading of the roll 28 of trash liners **28*a*. A projection integrally molded at the junction of the hemi-cylindrical and bottom wall 18 of the pail cooperatively mate with the latch mechanism 34 which in this case is a groove best seen in FIG. 12**.

OPERATION OF THE INVENTION

To use the self dispensing trash liner pail 14 as shown in FIGS. 3 and 4, simply place the roll 28 of trash liners onto the rectangular base 30. Pull the first trash liner **28*a* through the top slot 24 and then snap the hemi-cylindrical cover 32 onto the rectangular base by engaging the latch mechanism 34**.

To use the self dispensing trash liner pail 14 as shown in FIGS. 7 and 8, follow the instructions as in the above paragraph. Then remove the protective strips 38 from the adhesive pads 36 and press them onto the bottom wall 18 of the receptacle 16.

To use the self dispensing trash liner pail 14 as shown in FIGS. 9 through 12, simply place the roll 28 of trash liners 28*a* into the hemi-cylindrical cover 32 and pull the first trash liner 28*a* through the top slot 24. The rectangular base 30 can then be snapped into the hemi-cylindrical cover 32 and be retained thereto by the latch mechanism 34.

In all embodiments after a trash liner is filled, when it is removed from the pail 14, a new unused trash liner is automatically pulled from the dispenser 22 located at the bottom of the pail 14.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A self dispensing trash liner pail which comprises:

a) a receptacle have a bottom wall, and a plurality of upstanding side walls;

b) a dispenser including a rectangular base; a hemi-cylindrical cover to fit over said rectangular base and a latch mechanism between said rectangular base and said hemi-cylindrical cover, so that said hemi-cylindrical cover and said rectangular base can be removably attached to each other, the hemi-cylindrical cover having a top slot formed therethrough; and c) a continuous length of a plurality of separable trash liners carried as a roll within said dispenser, so that one said trash liner at a time can be pulled out through the top slot in said dispenser, can be separated and can be used in said receptacle for the disposal of trash and similar articles, said hemi-cylindrical cover being integrally formed with said bottom wall which is integrally joined to the sidewalls by a portion of U-section providing around engaging base and said latch mechanism comprises one of a resilient projection and a groove integrally molded at a junction of said hemi-cylindrical cover and said bottom all of said pail and the other of said resilient projection and said groove integrally molded with said rectangular base; said resilient projection and groove engage each other with a snap action so that both the hemi-cylindrical cover and said latch mechanism are recessed in said receptacle, spaced apart upward and inward from the ground engaging base and the sidewalls, respectively, and said rectangular base is removable away from said hemi-cylindrical cover at the underside of said receptacle, for loading of said roll of trash liners.

* * * * *